US005390428A

United States Patent [19]

Pummell

[11] Patent Number: 5,390,428

[45] Date of Patent: Feb. 21, 1995

[54] FILM TRANSPORT MEANS FOR USE IN A FILM DRYER

[75] Inventor: Leslie J. Pummell, Rickmansworth, United Kingdom

[73] Assignee: Eastman Kodak Company, Rochester, N.Y.

[21] Appl. No.: 85,517

[22] Filed: Jun. 30, 1993

[30] Foreign Application Priority Data

Jul. 31, 1992 [GB] United Kingdom ..... 9216334

[51] Int. Cl.[6] ..... F26B 3/34

[52] U.S. Cl. ..... 34/273; 34/465; 34/619; 34/629; 34/420

[58] Field of Search ..... 34/151, 155, 156, 152, 34/162, 420, 421, 266, 267, 273, 444, 459, 463, 465, 629, 618, 619, 639, 640, 658

[56] References Cited

U.S. PATENT DOCUMENTS 3,800,432 4/1974 Miyata et al. ..... 34/155 X 3,973,328 8/1976 Theobald ..... 34/4

FOREIGN PATENT DOCUMENTS 2221987 9/1974 France ..... F26B 15/18

1369298 10/1974 United Kingdom ..... F26B 3/28

1472175 5/1977 United Kingdom ..... F26B 3/28

1561897 3/1980 United Kingdom ..... F26B 3/28

*Primary Examiner*—Denise L. Gromada

*Attorney, Agent, or Firm*—Frank Pincelli

[57] ABSTRACT

The emulsion surface of a film may be damaged as it is pushed into or pulled through a dryer unit. Described herein is a transport arrangement for transporting a film through a dryer which comprises a conveyor belt for transporting the film, and air jets arranged above the surface of the belt. The film is placed on the conveyor belt with its emulsion surface uppermost. The air jets operate to hold the film against the belt as it is transported through the dryer as well as assisting in the removal of moisture from the emulsion surface.

10 Claims, 1 Drawing Sheet

8
9
10
11
12
13
13A
13B
14
15
16
17
18
7

FILM TRANSPORT MEANS FOR USE IN A FILM DRYER

FIELD OF THE INVENTION

This invention relates to film transport means for use in a film dryer.

BACKGROUND OF INVENTION

If film is pulled or pushed through a dryer, problems can arise because the emulsion surface of the film is touched by mechanical pulling or pushing means.

SUMMARY OF THE INVENTION

According to this invention film transport means for use in a film dryer comprise a conveyor for conveying film along a path, means operable to feed film strip onto the conveyor so as to lay it thereon emulsion side up, means operable to direct jets of air, towards the conveyor along the path whereby film strip laid on the conveyor is pressed against the conveyor by air that is so directed so that it is transported by movement of the conveyor. Thus the film can be transported without physical contact of its emulsion surface by mechanical means.

The means operable to direct jets of air may comprise a fan and a plenum chamber with holes formed in a wall which faces the conveyor, the fan being operable to blow the air through the holes and towards the conveyor. The preferred form of conveyor is a perforated belt, such as a belt formed of an open weave material which may be an open mesh polyester.

Preferably the perforated belt is operable to transport film through a dryer section of a film processor. Heating means, conveniently an infra-red heater, may be provided below the belt so that the film strip is warmed from its back which is held in contact with the belt by the air jets. Thus a temperature gradient is established in the film decreasing from the back to the emulsion surface thus minimising the risk that the top gelatin emulsion surface will "skin over" by being dried faster than the underlying layers. As a result the film can be dried without being contacted by any rollers during the critical drying stage when gelatin becomes sticky. Surface drying is unlikely, the drying rate can be maximised and post drying problems are minimised.

ADVANTAGEOUS EFFECT OF THE INVENTION

The invention enables separate strips of film to be dried individually. The film can be kept flat during drying by the action of the air jets directed onto it so that the risk of curling of the film is minimised. If cool, moist air is used the risk of generation of excessive static is minimised, and the film should emerge from the drying section in moisture equilibrium with the atmosphere in the room.

BRIEF DESCRIPTION OF THE DRAWINGS

One embodiment of this invention will be described now by way of example with reference to the accompanying

DESCRIPTION OF THE PREFERRED EMBODIMENT

Figures 1, 2:
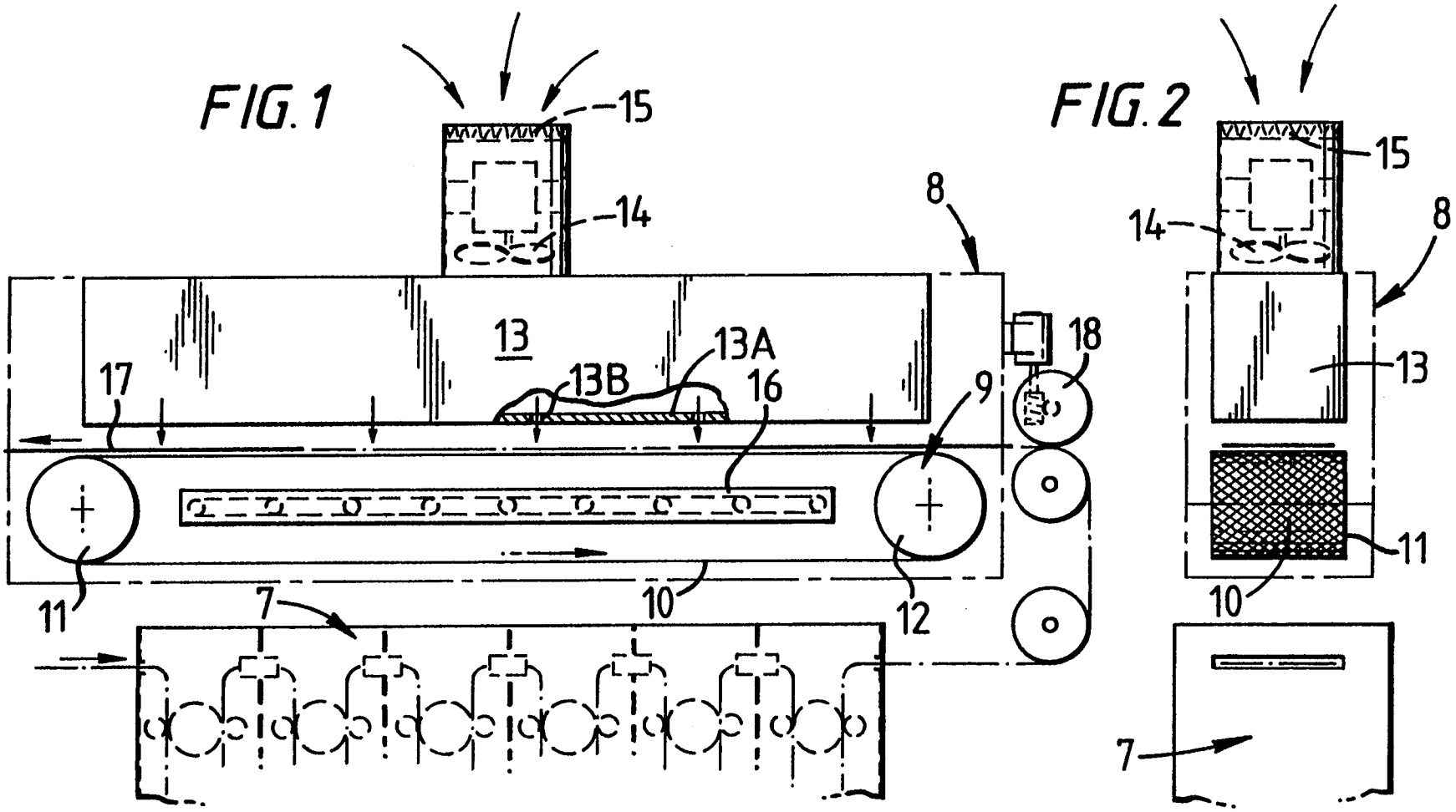
FIG. 1 is a schematic illustration of a dryer apparatus of a film processor incorporating film transport means made in accordance to the present invention.
FIG. 2 is an end view of the apparatus shown in FIG. 1.

The drawing shows an endless conveyor belt 10 formed of an open weave polyester material which runs on two spaced rollers 11 and 12, of which one is driven. A plenum chamber 13 extends above the upper run of the conveyor belt 10. The length of the plenum chamber 13 is substantially the same as the distance between the pair of rollers 11 and 12 and its width is at least the width of the conveyor belt 10. The bottom surface 13A of the plenum chamber 13 has a number of small holes drilled in it, each communicating with the hollow interior of the plenum chamber 13. A fan (not shown) is operable to draw room air through a filter and to force the air into plenum chamber 13 and cause it to emerge from the holes as a number of air jets which flow across the narrow gap between the bottom of the plenum chamber 13 and the upper run of the conveyor belt 10. The jets are arranged in a preselected pattern at fairly closely spaced intervals over the whole of the surface of the upper run of the conveyor belt 10. A flat low temperature infra-red heater (not shown) is mounted between the upper and lower runs of the conveyor belt 10 so as to direct its heat output at the underside of the upper run of the conveyor belt 10.

In operation the air of the air jets will pass through the interstices of the open mesh upper run of the conveyor belt 10 when they are played directly onto that conveyor belt 10.

Strips of film fed one at a time by conventional means 18 to the dryer from a preceding processing station of the film processor, say a washing station, are directed to and laid on the upper run of the open mesh polyester conveyor belt 10 as shown at 15. As the film strip 15 is advanced into the dryer and onto the upper run of the conveyor belt 10, more and more of the air jets are directed onto it. They exert a pressure urging the film strip 15 onto the conveyor belt 10 and, as the film strip 15 advances, that pressure increases as the number of jets acting directly upon it increases. The arrangement of the jets is such that sufficient pressure is generated to hold the film strip 15 on the conveyor belt 10 so that it moves along a path through the dryer with movement of the conveyor belt 10 and is pulled from the part of the apparatus that introduced it into the dryer.

The jets of air effectively remove surface moisture from the film. The underside of the film is heated by the infra-red heater 16 and a temperature gradient is established in the film, the amount of heat diminishing from the underside to the gelatin emulsion surface. The use of a low temperature infra-red heater 16 enables heat radiation to be evenly admitted to the film and thus avoids the need for mirrors and the other devices to concentrate the heat onto the film.

Triacetate film support, which is used for color negative film processed in conventional film processors, is strongly absorbing in the region 7 to 10 microns where the so-called perfect (black body) infra-red emitters reach peak emissions at temperatures of around 80° C. At this low temperature, danger to the film support is minimised and heat transfer efficiency is maximised.

The air of the air jets directed onto film strip 15 on the conveyor belt 10 does several jobs. In addition to providing the extra downwards force that holds the film strip 15 on the belt 10 and enables the belt 10 to transport the film strip 15, it scrubs the surface of the film strip 15, removing moisture, whereby it promotes efficient mass transfer. It keeps the film strip 15 flat whilst it is being dried and it helps to ensure the film strip 15 is in moist equilibrium with the atmosphere in the room so that the risk of film curl after drying is minimised.

Moisture emitted from the underside of the film strip 15 by evaporation because of the heating effect of the infra-red heaters will pass through the interstices of the open mesh polyester belt 10 on which the film strip 15 is supported.

What is claimed:

1. A film processor having a dryer section and a film transport means for use in said film dryer, said film transport means comprising a conveyor for conveying film along a path, means operable to feed film onto the conveyor so as to lay it thereon emulsion side up, means operable to direct jets of air towards the conveyor along the path whereby film laid on the conveyor is pressed against the conveyor by air that is so directed so that it is transported by movement of the conveyor, said film dryer having heating means which are provided below the conveyor so that the film is warmed from its back which is being held in contact with the belt by the air jets.

2. A film processor according to claim 1, wherein the means operable to direct jets of air comprises a fan and a plenum chamber with holes formed in a wall which faces the conveyor, the fan being operable to blow the air through the holes and towards the conveyor.

3. A film processor according to claim 2, wherein the conveyor is perforated.

4. A film processor according to claim 1, wherein the conveyor is perforated.

5. A film processor according to claim 3, wherein the perforated conveyor is formed of an open weave material.

6. A film processor according to claim 1, wherein the heating means comprises an infra-red heater.

7. A method for transporting and drying a film in a film processor, comprising the steps of:

a. conveying the film along a path on a conveyor such that the film is emulsion side up;

b. directing jets of air toward the conveyor along the path whereby the film is pressed against the conveyor by said jets of air so as to maintain the film substantially flat as it is moved by the conveyor; and c. applying heat below the conveyor so that the film is warmed from its backside while in contact with the conveyor.

8. A method according to claim 7 wherein said jets of air are provided by a fan in a plenum chamber with holes formed in the wall which faces the conveyor, the fan being operable to blow the air through the holes and toward the conveyor.

9. A method according to claim 7 wherein said heating means comprises an infra-red heater.

10. Film transport means for use in a film dryer comprising a conveyor conveying film along a path, means operable to feed the film onto the conveyor so as to lay it thereon with the emulsion side up, means operable to direct jets of air toward the conveyor along the path whereby the film that was laid on the conveyor is pressed substantially flat against the conveyor by air that is so directed so that it is transported by movement of the conveyor; and maintaining said film in said position until said film has been dried, heating means are provided below the conveyor so that the film is warmed from its backside while said film is in substantially flat contact with the conveyor by the air jets.

* * * * *